US011139593B2

(12) United States Patent
Ho

(10) Patent No.: US 11,139,593 B2
(45) Date of Patent: Oct. 5, 2021

(54) CONNECTING STRUCTURE AND METHOD FOR MANUFACTURING ELECTRICAL CONNECTOR

(71) Applicant: LOTES CO., LTD, Keelung (TW)

(72) Inventor: Chien Chih Ho, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/740,866

(22) Filed: Jan. 13, 2020

(65) Prior Publication Data

US 2020/0227840 A1 Jul. 16, 2020

(30) Foreign Application Priority Data

Jan. 15, 2019 (CN) ..... 201910035137.3

(51) Int. Cl.

| | |
|---|---|
| ***H01R 4/18*** | (2006.01) |
| ***H01R 4/20*** | (2006.01) |
| ***H01R 4/62*** | (2006.01) |
| ***H01R 13/24*** | (2006.01) |

(52) U.S. Cl.

CPC ..... *H01R 4/187* (2013.01); *H01R 4/20* (2013.01); *H01R 4/62* (2013.01); *H01R 13/2428* (2013.01)

(58) Field of Classification Search

CPC . H01R 4/187; H01R 4/20; H01R 4/62; H01R 4/00; H01R 4/023

USPC ..... 439/78, 83, 55, 80, 81, 82

See application file for complete search history.

(56) References Cited

U.S. PATENT DOCUMENTS

| | | | | | |
|---|---|---|---|---|---|
| 3,750,252 | A * | 8/1973 | Landman | ..... | H05K 3/3405 428/571 |
| 4,044,888 | A * | 8/1977 | Schachter | ..... | H01R 43/205 206/717 |
| 5,052,954 | A * | 10/1991 | Seidler | ..... | H05K 3/3405 439/876 |
| 5,059,756 | A * | 10/1991 | Henschenp | ..... | B23K 3/0475 219/85.22 |

(Continued)

FOREIGN PATENT DOCUMENTS

| | | |
|---|---|---|
| CN | 101670489 A | 3/2010 |
| CN | 204156149 U | 2/2015 |

(Continued)

*Primary Examiner* — Peter G Leigh

(74) *Attorney, Agent, or Firm* — Locke Lord LLP; Tim Tingkang Xia, Esq.

(57) ABSTRACT

A connecting structure includes at least one conductive terminal having a body, a conducting portion connected below the body, a pre-breaking portion provided at an upper end of the body, and a temporary soldering portion connected above the pre-breaking portion; a first strip connected to the conducting portion; and a second strip soldered to the temporary soldering portion. A method for manufacturing an electrical connector includes: forming a first strip and at least one conductive terminal connected thereto; soldering a second strip to the temporary soldering portion of the conductive terminal; separating the conducting portion of the conductive terminal and the first strip; operating the second strip to control the conductive terminal to be mounted to a housing; and disconnecting the pre-breaking portion of the conductive terminal, and removing the second strip and the temporary soldering portion of the conductive terminal.

7 Claims, 8 Drawing Sheets

(56) References Cited

U.S. PATENT DOCUMENTS 5,163,849 A * 11/1992 Fogg ..... H01R 13/436 439/497
5,411,420 A * 5/1995 Dennis ..... H01R 4/021 439/83
6,155,845 A * 12/2000 Lin ..... H05K 7/1061 439/83
6,863,578 B2 * 3/2005 Templin ..... H01R 12/57 439/876
7,128,622 B2 * 10/2006 Tsai ..... H01R 12/7076 439/874
7,278,864 B2 * 10/2007 Tsai ..... H05K 3/3426 439/83
7,497,744 B2 * 3/2009 Tsai ..... H01R 12/57 439/331
7,530,820 B2 * 5/2009 Jeon ..... H05K 3/3426 439/83
7,553,202 B2 * 6/2009 Ma ..... H01R 12/57 439/839
7,775,805 B2 * 8/2010 Liao ..... H01R 13/2435 439/66
7,780,456 B2 * 8/2010 Chen ..... H05K 7/1069 439/66
7,837,522 B1 * 11/2010 Hoover ..... H01R 43/0256 439/876
7,857,632 B2 * 12/2010 Liu ..... H01R 13/2492 439/66
7,878,870 B2 * 2/2011 Fan ..... H05K 7/1069 439/862
8,235,734 B2 * 8/2012 Ju ..... H01R 12/57 439/83
9,172,161 B2 * 10/2015 Walden ..... H01R 13/2435
9,954,312 B1 * 4/2018 Ju ..... H01R 12/707
10,116,079 B1 * 10/2018 Ju ..... H01R 12/7076
2018/0198226 A1 * 7/2018 Ju ..... H01R 12/57
2018/0205161 A1 * 7/2018 Ju ..... H01R 4/024
2018/0269613 A1 * 9/2018 Ju ..... H01R 12/7076
2018/0287269 A1 * 10/2018 Ju ..... H01R 12/714
2018/0331441 A1 * 11/2018 Huang ..... H01R 12/716
2018/0331442 A1 * 11/2018 Huang ..... H01R 13/2407
2018/0366881 A1 * 12/2018 Chang ..... H01R 13/41
2019/0006807 A1 * 1/2019 Ju ..... H01R 12/585

FOREIGN PATENT DOCUMENTS

CN 107565237 A 1/2018
CN 207765665 U 8/2018
JP 2014164945 A 9/2014

* cited by examiner

CONNECTING STRUCTURE AND METHOD FOR MANUFACTURING ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201910035137.3 filed in China on Jan. 15, 2019. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to a connecting structure and a method for manufacturing an electrical connector, and more particularly to a connecting structure for transmitting high frequency signals and a method for manufacturing an electrical connector.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector has multiple terminals. Each of the terminals has a base, two elastic arms connected below the base, a soldering portion connected above the base, and a strip connecting portion connected above the base and protruding from one sides of the two elastic arms. The strip connecting portion is used for connecting a strip, and the elastic arms, the base and the soldering portion are used for conducting currents. When the terminals are still connected to the strip, a distance between the terminals is determined based on the overall width of the terminals, and necessarily includes the proper gap between the terminals, and the widths of the two elastic arms and the laterally protruding strip connecting portion. Therefore, the distance between the terminals is large, and the quantity of terminals carried on the strip per unit length is small, which is not beneficial to save materials. In addition, when multiple terminals transmit high frequency signals, the laterally protruding strip connecting portion does not constitute a path, and does not contribute to the transmission of the signal, but increases the facing area between the different terminals, thereby increasing the capacitance between the terminals. Therefore, crosstalk interference is easily formed between different terminals, which is disadvantageous for transmitting high frequency signals.

Therefore, a heretofore unaddressed need to design an improved connecting structure and a method for manufacturing an electrical connector exists in the art to address the aforementioned deficiencies and inadequacies.

SUMMARY

In view of the deficiency in the background, the present invention is directed to a connecting structure that saves space occupied by conductive terminals and reduces crosstalk between the conductive terminals, and a method for manufacturing an electrical connector.

To achieve the foregoing objective, the present invention adopts the following technical solutions:

A connecting structure includes: at least one conductive terminal, wherein the conductive terminal has: a body; a conducting portion connected below the body; a pre-breaking portion provided at an upper end of the body; and a temporary soldering portion connected above the pre-breaking portion; a first strip, connected to the conducting portion; and a second strip, soldered to the temporary soldering portion.

In certain embodiments, the temporary soldering portion and the second strip are attached to each other in a thickness direction of a metal plate forming the conductive terminal.

In certain embodiments, a lower end of the conducting portion has a strip connecting portion connected to the first strip, and the conducting portion further has two retaining arms located at two opposite sides of the strip connecting portion to clamp a solder.

In certain embodiments, the body extends upward at two sides of the temporary soldering portion to form two elastic arms.

In certain embodiments, each of the elastic arms has a first section connected to the body, a bending section connected to the first section, and a second section connected to the bending section, the two first sections of the two elastic arms are parallel to each other, the two second sections of the two elastic arms are parallel to each other, and a distance between the two first sections is greater than a distance between the two second sections.

In certain embodiments, a through slot is formed between the two elastic arms, the conductive terminal has a bridge portion connecting the two elastic arms, and the bridge portion and the body are located at two opposite ends of the through slot.

In certain embodiments, the through slot comprises a first through slot and a second through slot in communication with each other, the first through slot is adjacent to the body, and a width of the connecting portion is greater than a width of the second through slot.

In certain embodiments, the bridge portion connects tail ends of the two elastic arms to upward abut a chip module.

In certain embodiments, the elastic arms bend toward a thickness direction of the body.

A connecting structure includes: at least one conductive terminal, wherein the conductive terminal has: a body; a conducting portion connected below the body; two elastic arms extending upward from the body; a bridge portion connecting the two elastic arms; a pre-breaking portion provided at an upper end of the body; and a temporary soldering portion connected above the pre-breaking portion, wherein the pre-breaking portion and the temporary soldering portion are located between the two elastic arms; a first strip, connected to the conducting portion; and a second strip, soldered to the temporary soldering portion.

A method for manufacturing an electrical connector includes: step S1: forming a first strip and at least one conductive terminal connected to the first strip, wherein the conductive terminal has a body, a conducting portion provided below the body and connected to the first strip, and a pre-breaking portion and a temporary soldering portion sequentially extending from an upper end of the body; step S2: soldering a second strip to the temporary soldering portion; step S3: separating the conducting portion and the first strip; step S4: operating the second strip to control the conductive terminal to be mounted to a housing; and step S5: disconnecting the pre-breaking portion, and removing the second strip and the temporary soldering portion.

In certain embodiments, the second strip is made of stainless steel, the conductive terminal is made of a copper alloy, and in the step S2, the second strip is soldered to the temporary soldering portion by laser soldering.

In certain embodiments, a laser beam used for laser soldering is directed from the second strip to the temporary soldering portion.

In certain embodiments, the laser beam is perpendicular to the second strip.

In certain embodiments, in the step S1, the temporary soldering portion is formed in a flat plate shape; and in the step S2, the second strip is attached and soldered to one of two plate surfaces of the temporary soldering portion.

In certain embodiments, in the step S1, nickel is plated on the conductive terminal.

In certain embodiments, in the step S3, the first strip is removed by laser cutting.

Compared with the related art, the connecting structure and the method for manufacturing the electrical connector according to certain embodiments of the present invention has the following beneficial effects. The conducting portion connected to the first strip is located below the body, and the temporary soldering portion soldered to the second strip is located between the two elastic arms, such that the conductive terminal does not have the strip connecting portion laterally protruding to be connected to the strip. Therefore, the distance between the conductive terminals can be reduced, and the strip per unit length can carry more conductive terminals, which is beneficial to save materials. After the conductive terminal is assembled to the base, the temporary soldering portion is removed, and the directly facing area between the conductive terminals is reduced, such that the capacitance between the conductive terminals is reduced, and the crosstalk interference between the conductive terminals is reduced.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
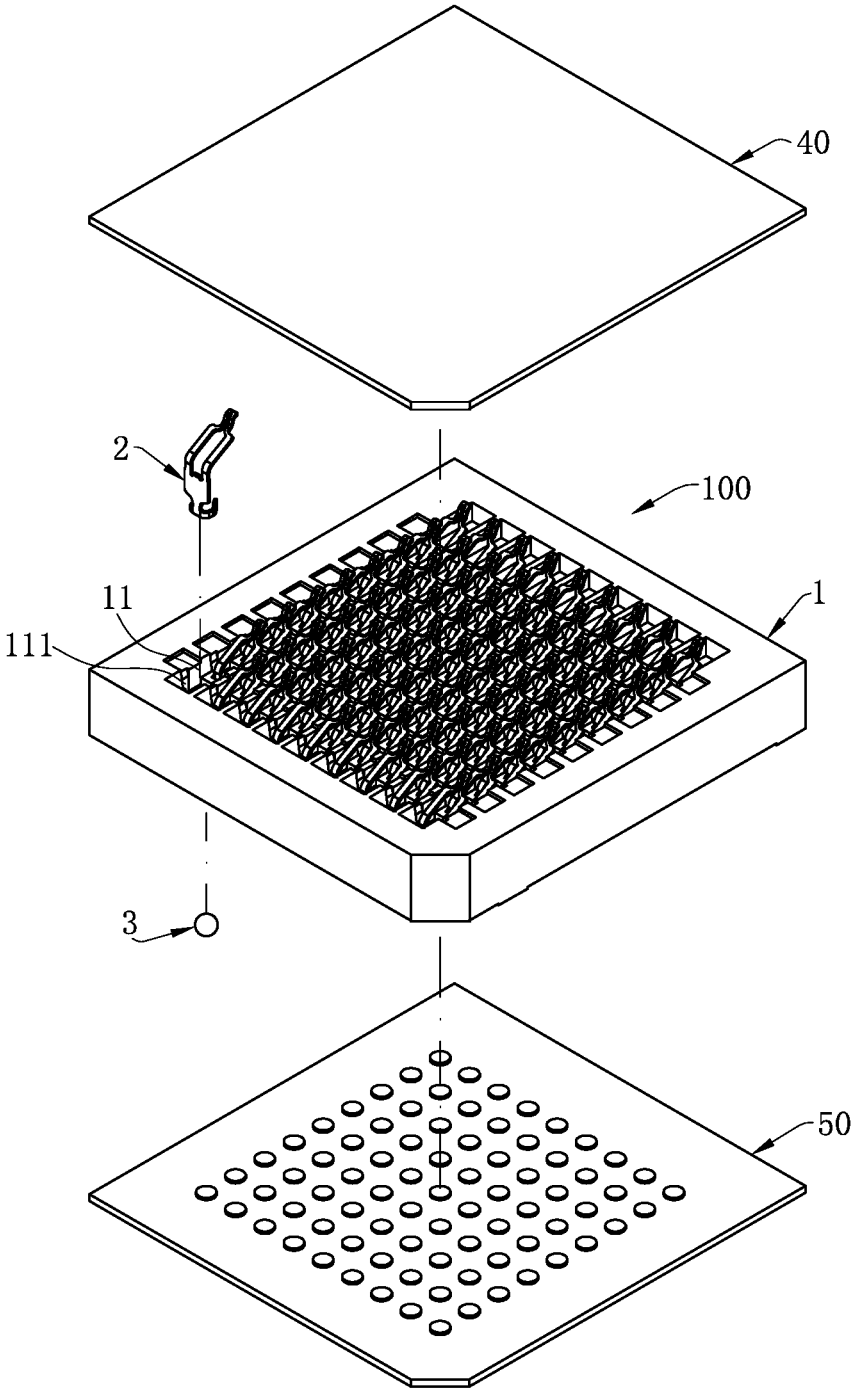
FIG. 1 is a perspective view of an electrical connector, a chip module and a circuit board according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to a connecting structure and a method for manufacturing an electrical connector.

FIG. 1 shows an electrical connector 100 according to certain embodiments of the present invention, which is used for electrically connecting a chip module 40 to a circuit board 50. The electrical connector 100 includes a housing 1 and multiple conductive terminals 2 mounted to the housing 1. Each of the conductive terminals 2 is fixed to the circuit board 50 through a solder 3.

As shown in FIG. 1, the housing 1 is made of an insulating material and has a substantially square shape, and has multiple accommodating holes 11 arranged in a matrix. Each of the accommodating holes 11 accommodates a corresponding one of the conductive terminals 2, and two sidewalls of each of the accommodating holes 11 are recessed to form two fastening slots 111 to fastening two sides of the corresponding conductive terminal 2 to limit the conductive terminal 2 from moving downward.

Figure 2:
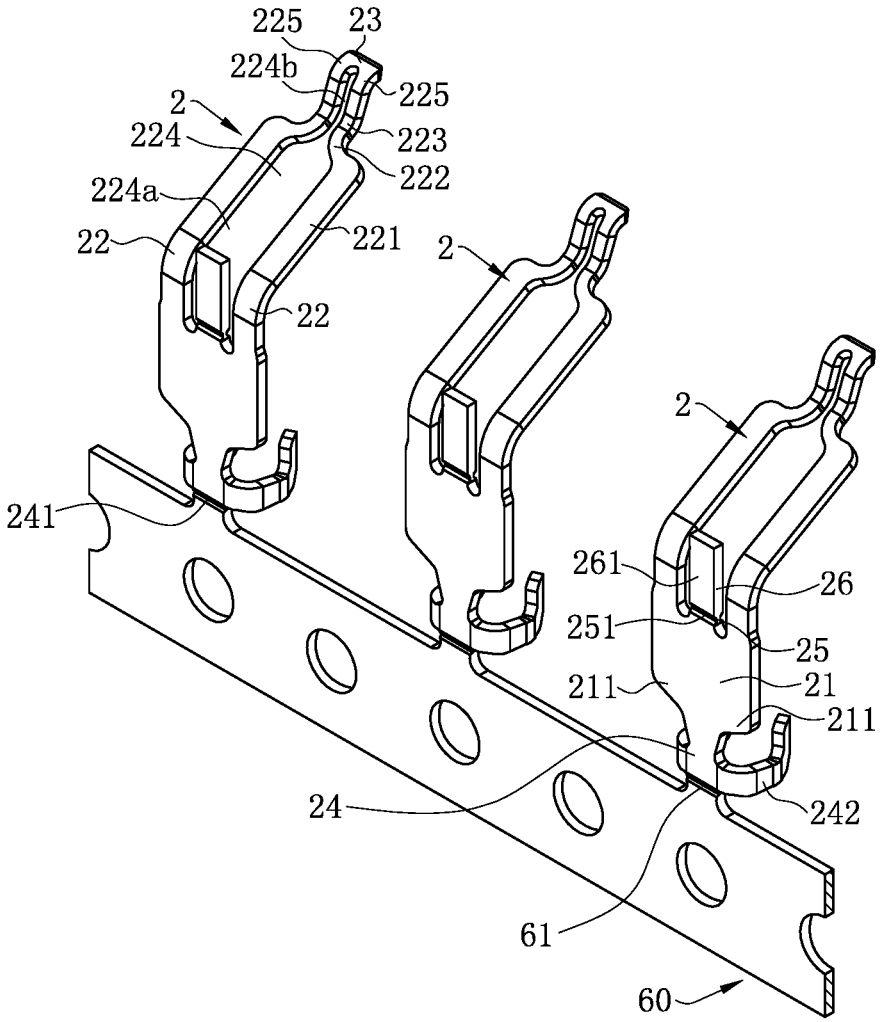
FIG. 2 is a schematic view showing the connection between the conductive terminal and the first strip according to the embodiment of the present invention.
Figure 6:
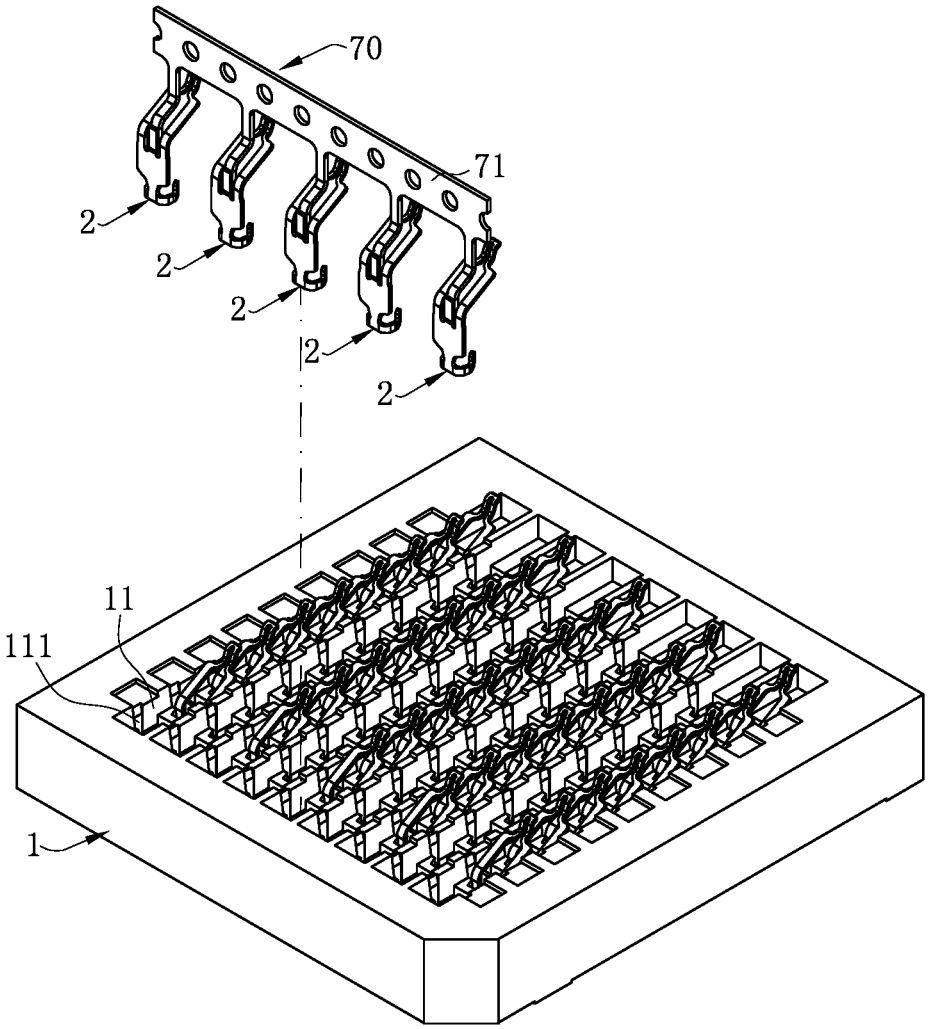
FIG. 6 is a schematic view of the conductive terminal of FIG. 4 being mounted to the base after the first strip is removed.

As shown in FIG. 1, FIG. 2 and FIG. 6, the conductive terminals 2 are assembled to the accommodating holes 11 downward from top thereof. The conductive terminals 2 are made of metal. Each of the conductive terminals 2 has a body 21 in a flat plate shape, and two sides of the body 21 have two fastening portions 211. Each of the fastening portions 211 is accommodated in a corresponding fastening slot 111 and interferes with the housing 1 to limit the conductive terminal 2 from moving downward.

Figure 7:
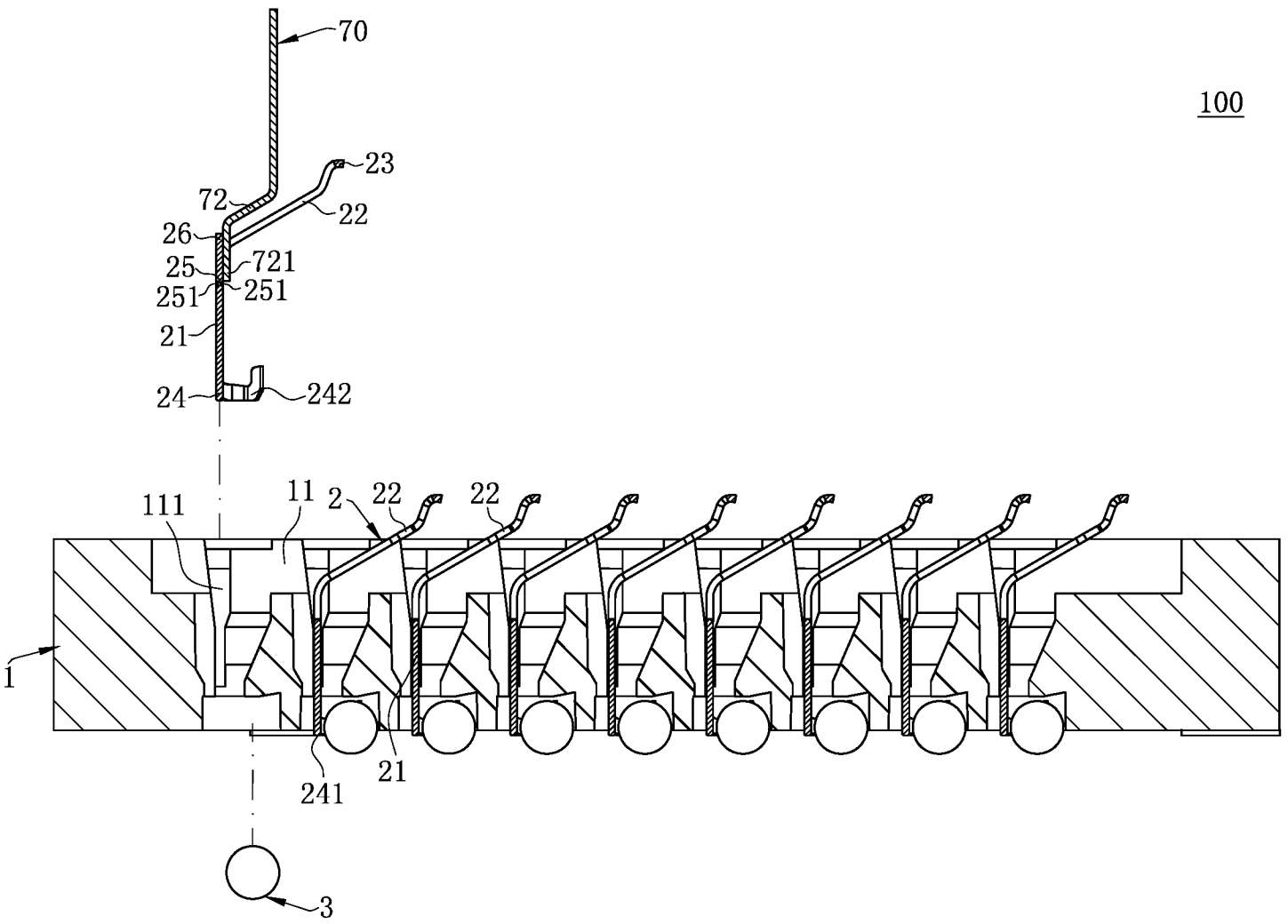
FIG. 7 is a sectional view of FIG. 6.

As shown in FIG. 2 and FIG. 7, the upper end of the body 21 bends and extends upward to form two elastic arms 22, and the elastic arms 22 bend in a thickness direction of the body 21 (i.e., a thickness direction of the metal plate forming the conductive terminal 2). Each of the elastic arms 22 has a first section 221 connected to the body 21, a bending section 222 connected to the first section 221, and a second section 223 connected to the bending section 222. The first section 221 and the second section 223 are provided in parallel. The two first sections 221 of the two elastic arms 22 are parallel to each other, and the two second sections 223 of the two elastic arms 22 are parallel to each other. A distance between the two first sections 221 is greater than a distance between the two second sections 223. A through slot 224 is formed between the two elastic arms 22. The through slot 224 includes a first through slot 224*a* and a second through slot 224*b* in communication with each other. The first through slot 224*a* is adjacent to the body 21 and is located between the two first sections 221, and the second through slot 224*b* is located between the two second sections 223. The conductive terminals 2 are horizontally arranged in multiple rows along the extending direction of the elastic arms 22. The elastic arm 22 of one of the conductive terminals 2 in each row extends above the body 21 of another conductive terminal 2 in a previous row, and the first through slot 224*a* of each conductive terminal 2 provides a reserved space for the elastic arms 22 of other conductive terminals 2 when the chip module 40 abuts the conductive terminal 2 downward.

Figure 3:
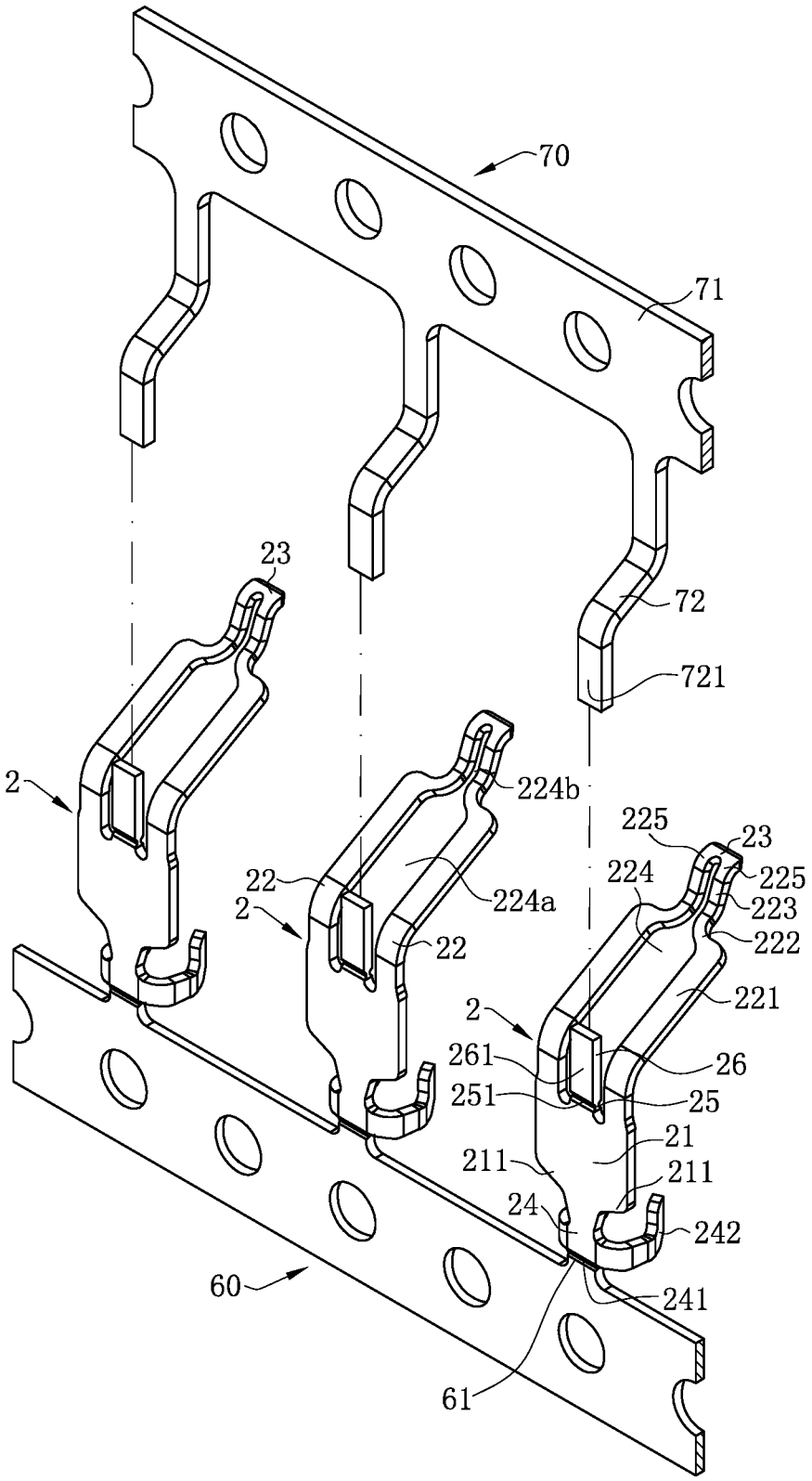
FIG. 3 is a schematic view of the conductive terminal of FIG. 2 ready to be connected to the second strip.

As shown in FIG. 2 and FIG. 3, each of the elastic arms 22 has a contact portion 225 at a tail end away from body 21. Each of the conductive terminals 2 has a bridge portion 23 connecting the two contact portions 225 of the two elastic arms 22. That is, the bridge portion 23 connects the tail ends of the two elastic arms 22, and the bridge portion 23 and the body 21 are located at two opposite ends of the through slot 224. The two contact portions 225 and the bridge portion 23 are used together to abut the chip module 40 upward, and the bridge portion 23 increases the contact area between the conductive terminal 2 and the chip module 40, thereby reducing the contact resistance between the conductive terminal 2 and the chip module 40.

As shown in FIG. 2 and FIG. 7, a conducting portion 24 is connected below the body 21. A lower end of the conducting portion 24 has a strip connecting portion 241 to be connected to the first strip 60. The first strip 60 and the conductive terminal 2 are stamped and formed from the same metal plate. The conducting portion 24 has two retaining arms 242 located at two opposite sides of the strip connecting portion 241 and used to clamp the solder 3.

As shown in FIG. 2 to FIG. 5, each of the conductive terminals 2 is provided with a pre-breaking portion 25 at the upper end of the body 21 and between the two elastic arms 22. The pre-breaking portion 25 includes two grooves 251 of equal height located at two sides of the conductive terminal 2 in a thickness direction. A temporary soldering portion 26 in a flat plate shape is formed by extending vertically above the pre-breaking portion 25 to be soldered to a second strip 70 to assist mounting the whole conductive terminal 2 to the housing 1. The temporary soldering portion 26 includes two plate surfaces 261. One of the plate surfaces 261 is a soldering surface, and a width of the temporary soldering portion 26 is greater than a width of the second through slot 224*b*.

As shown in FIG. 2 to FIG. 8, the manufacturing method of the electrical connector 100 according to certain embodiments of the present invention includes the following steps:

As shown in FIG. 2, step S1: a first strip 60 and multiple conductive terminals 2 connected to the first strip 60 are formed on the same copper alloy plat. The structure of each conductive terminal 2 has been described above, and is thus not elaborated herein. A breaking groove 61 is stamped and formed at each of two opposite sides of the joint between the strip connecting portion 241 and the first strip 60 in the thickness direction of the metal plate to facilitate breaking. After step S1, the conductive terminals 2 may be electroplated to enhance the use performance.

Step S2: a second strip 70 is soldered to the temporary soldering portion 26.

As shown in FIG. 3, prior to the step S2, the second strip 70 is stamped and formed on a stainless steel plate. The second strip 70 includes a base 71 extending horizontally and multiple connecting arms 72 protruding downward from the base 71. A bonding portion 721 in a flat plate shape is connected to a lower end of each of the connecting arms 72.

Figure 4:
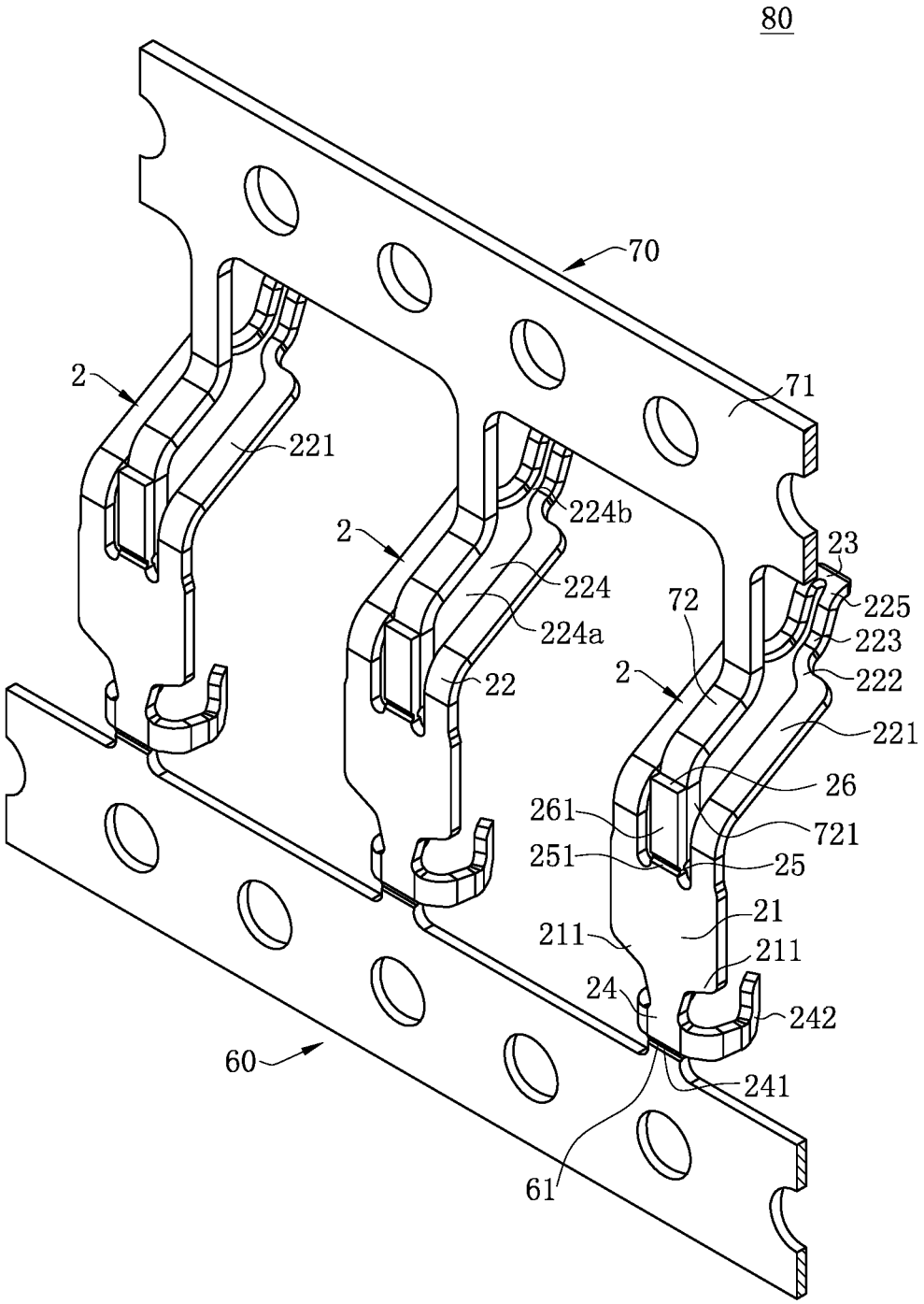
FIG. 4 is a perspective view of a connecting structure according to one embodiment of the present invention.
Figure 5:
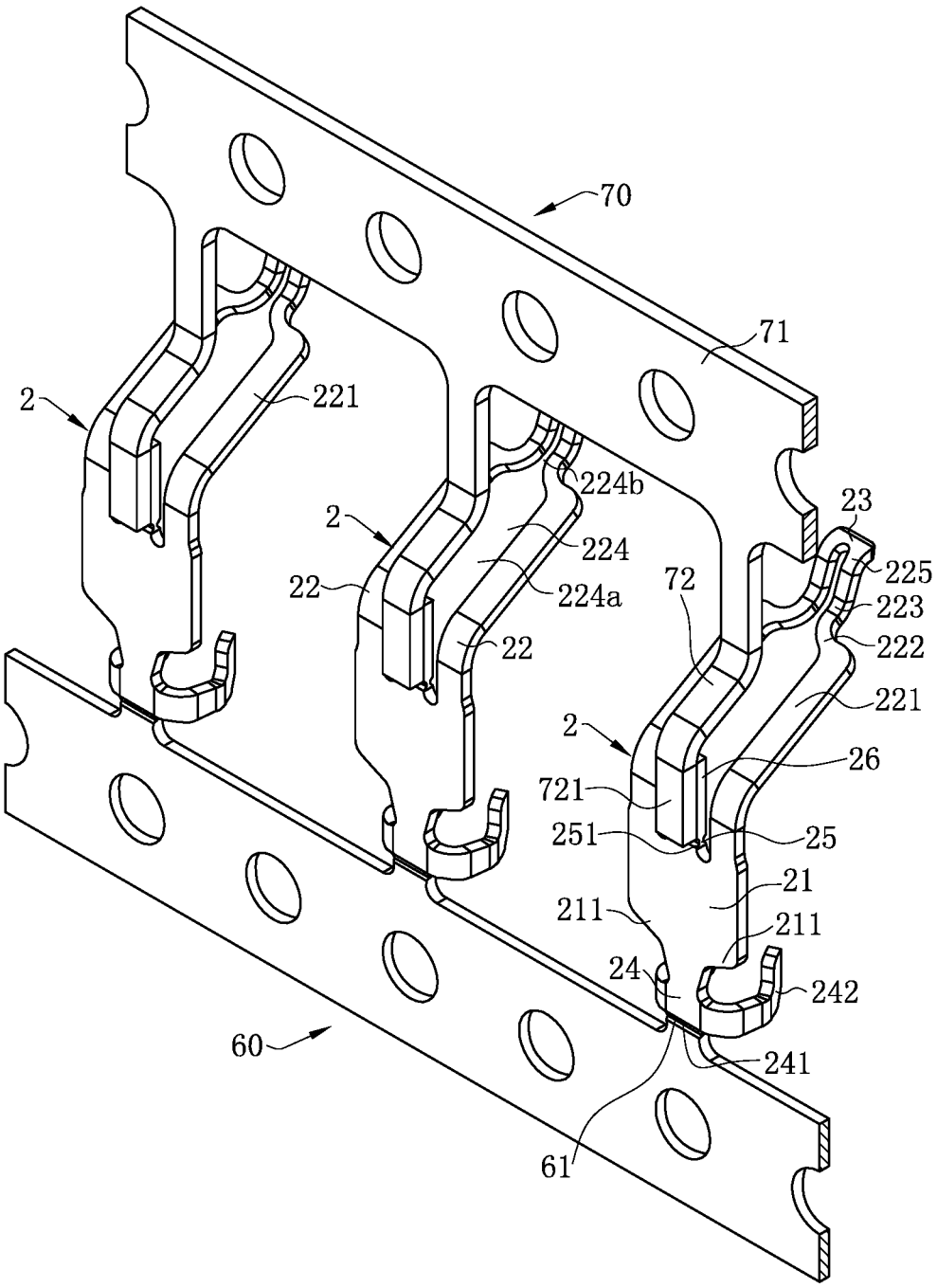
FIG. 5 is a perspective view of a connecting structure according to another embodiment of the present invention.

As shown in FIG. 3 and FIG. 4, the specific operation of the step S2 is as follows. The bonding portion 721 of the second strip 70 is attached to the soldering surface of the temporary soldering portion 26 to form a vertical soldering region. Then a laser beam is irradiated to the bonding portion of the soldering region 721, and the bonding portion 721 is soldered to the temporary soldering portion 26 by the laser soldering technology. In certain embodiments, by irradiating the laser beam to the bonding portion 721 perpendicularly, the reflectance of the laser beam can be reduced, so as to improve the energy utilization efficiency in the laser soldering process. In this embodiment, the plate surface 261 of the temporary soldering portion 26 facing the through slot 224 is used as a soldering surface, such that the bonding portion 721 passes through the through slot 224. In another embodiment, as shown in FIG. 5, the other plate surface 261 of the temporary soldering portion 26 may be used as a soldering surface, and the bonding portion 721 does not pass through the through slot 224.

Therefore, after step S2, a connecting structure 80 is obtained, which includes at least one conductive terminal 2, and the first strip 60 is connected below the conductive terminal 2. The first strip 60 is integrally formed with the conductive terminal 2. The second strip 70 is soldered above the body 21 of the conductive terminal 2, and the second strip 70 and the conductive terminal 2 are made of different materials.

Step S3: the conducting portion 24 and the first strip 60 are separated. That is, by swinging the first strip 60 back and forth, the conductive terminal 2 and the first strip 60 are disconnected at the breaking groove 61 of the joint of the two components, and then the first strip 60 is removed. In other embodiments, the connection between the first strip 60 and the conducting portion 24 can be cut off by a cutter or a laser, or the like.

As shown in FIG. 6 and FIG. 7, step S4: the conductive terminal 2 is controlled by operating the second strip 70 with a machine to be assembled into the corresponding accommodating hole 11 of the housing 1 downward from top thereof.

Figure 8:
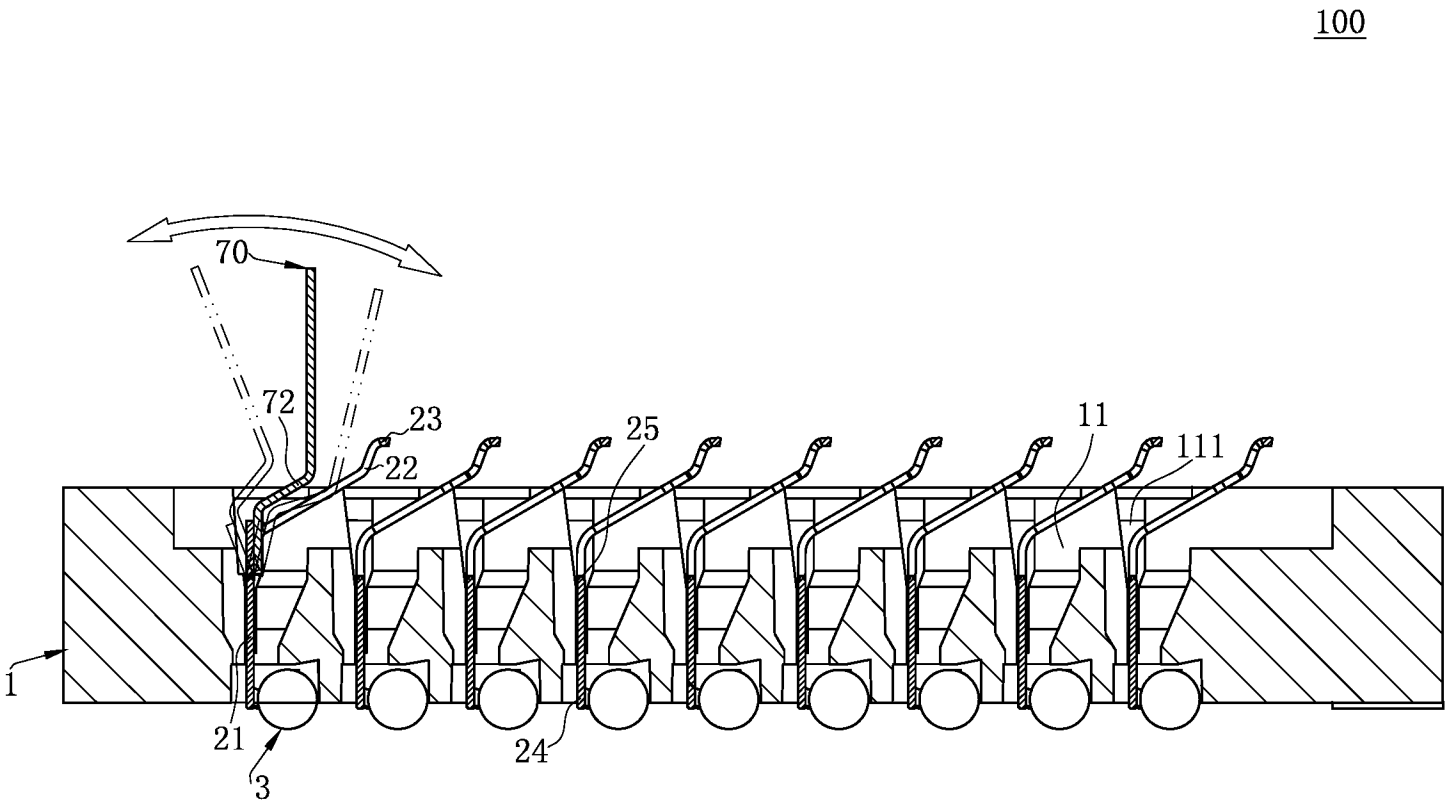
FIG. 8 is a schematic view of the conductive terminal of FIG. 7 being mounted to an accommodating hole, where the second strip and the temporary soldering portion are removed.

As shown in FIG. 8, step S5: the pre-breaking portion 25 is disconnected and the second strip 70 and the temporary soldering portion 26 are removed. In this embodiment, by swinging the second strip 70, the pre-breaking portion 25 is broken by the groove 251. The second strip 70 and the temporary soldering portion 26 are separated from the body 21 and simultaneously removed. In the process of swinging the second strip 70, the first through slot 224*a* provides a reserved space for the swing of the second strip 70. In other embodiments, the pre-breaking portion 25 may be cut off by a cutter or a laser, or the like.

After the step S5, the solder 3 is fixed between the two retaining arms 242 of the conducting portion 24.

To sum up, the connecting structure and the method for manufacturing the electrical connector according to certain embodiments of the present invention have the following beneficial effects:

1. The strip connecting portion 241 connected to the first strip 60 is located below the body 21, and the temporary soldering portion 26 soldered to the second strip 70 is located between the two elastic arms 22, such that the conductive terminal 2 does not have the strip connecting portion laterally protruding to be connected to the strip. Therefore, the distance between the conductive terminals 2 can be reduced, and the strip per unit length can carry more conductive terminals 2, which is beneficial to save materials.

2. After the conductive terminal 2 is assembled to the housing 1, the temporary soldering portion 26 is removed, and the directly facing area between the conductive terminals 2 is reduced, such that the capacitance between the conductive terminals 2 is reduced, and the crosstalk interference between the conductive terminals 2 is reduced.

3. The arrangement of the two elastic arms 22 increases the conductive paths of the conductive terminal 2, and the first through slot 224*a* provided between the two elastic arms 22 provides a reserved space for the second strip 90 when the pre-breaking portion 25 is broken in the step S5. The conductive terminals 2 are horizontally arranged in multiple rows along the extending direction of the elastic arms 22. The elastic arm 22 of one of the conductive terminals 2 in each row extends above the body 21 of another conductive terminal 2 in a previous row, and the first through slot 224*a* of each conductive terminal 2 provides a reserved space for the elastic arms 22 of other conductive terminals 2 when the chip module 40 abuts the conductive terminals 2 downward.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A method for manufacturing an electrical connector, comprising:

step S1: forming a first strip and at least one conductive terminal connected to the first strip, wherein the conductive terminal has a body, a conducting portion provided below the body and connected to the first strip, and a pre-breaking portion and a temporary soldering portion sequentially extending from an upper end of the body;

step S2: soldering a second strip to the temporary soldering portion;

step S3: separating the conducting portion and the first strip;

step S4: operating the second strip to control the conductive terminal to be mounted to a housing; and step S5: disconnecting the pre-breaking portion, and removing the second strip and the temporary soldering portion.

2. The method according to claim 1, wherein the second strip is made of stainless steel, the conductive terminal is made of a copper alloy, and in the step S2, the second strip is soldered to the temporary soldering portion by laser soldering.

3. The method according to claim 2, wherein a laser beam used for laser soldering is directed from the second strip to the temporary soldering portion.

4. The method according to claim 3, wherein the laser beam is perpendicular to the second strip.

5. The method according to claim 1, wherein in the step S1, the temporary soldering portion is formed in a flat plate shape; and in the step S2, the second strip is attached and soldered to one of two plate surfaces of the temporary soldering portion.

6. The method according to claim 1, wherein in the step S1, nickel is plated on the conductive terminal.

7. The method according to claim 1, wherein in the step S3, the first strip is removed by laser cutting.

* * * * *